US011559148B2

(12) United States Patent
Martin et al.

(10) Patent No.: US 11,559,148 B2
(45) Date of Patent: Jan. 24, 2023

(54) MIRROR DISPLAY ASSEMBLY AND RETAIL DISPLAY SYSTEM

(71) Applicant: LIBERTY HARDWARE MFG. CORP., Winston-Salem, NC (US)

(72) Inventors: Ryan Patrick Martin, Kernersville, NC (US); Jeffrey John Mathison, Chicago, IL (US); Earl David Forrest, Asheboro, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 265 days.

(21) Appl. No.: 15/331,287

(22) Filed: Oct. 21, 2016

(65) Prior Publication Data

US 2017/0224133 A1 Aug. 10, 2017

Related U.S. Application Data

(63) Continuation-in-part of application No. 15/016,704, filed on Feb. 5, 2016, now Pat. No. 9,924,809.

(51) Int. Cl.
*A47F 7/00* (2006.01)
*A47F 11/00* (2006.01)
(Continued)

(52) U.S. Cl.
CPC ..... *A47F 7/0042* (2013.01); *A47F 11/00* (2013.01); *A47G 1/16* (2013.01); *F21V 23/0471* (2013.01); *F21V 33/0028* (2013.01); *A47G 2001/1673* (2013.01); *F21W 2131/405* (2013.01); *F21Y 2115/10* (2016.08)

(58) Field of Classification Search
CPC .... E04H 3/00; E04H 3/02; E04H 3/04; E04H 14/00; A47F 3/00; A47F 3/0434;
(Continued)

(56) References Cited

U.S. PATENT DOCUMENTS 908,608 A 1/1909 Pullen
1,354,270 A 9/1920 Wood
(Continued)

FOREIGN PATENT DOCUMENTS

BR 102012014391 A2 6/2014
CN 201589049 U 9/2010
(Continued)

OTHER PUBLICATIONS

About Smart Mirror Glass, Two Way Mirrors Privacy & Security Products, Product Comparison, 3 pages, Dec. 22, 2015.
(Continued)

*Primary Examiner* — Jeffrey A Shapiro
(74) *Attorney, Agent, or Firm* — Brooks Kushman P.C.; Lora Graentzdoerffer

(57) ABSTRACT

A retail display system is provided with a point-of-sale display unit sized to be received in a retail store aisle. A first and a second plurality of mirror panes are oriented within the display unit, which are formed from different material compositions. A mirror display assembly is provided with samples from the first and second pluralities of mirror panes to visually demonstrate the material composition difference between the first plurality of mirror panes and the second plurality of mirror panes. The mirror display assembly is provided with a support with a base. An image surface is mounted upon the base. A first sample mirror pane is mounted to the support and oriented at an angle relative to the image surface to reflect the image surface. A second sample mirror pane is mounted to the support and oriented at an angle relative to the image surface to reflect the image surface.

11 Claims, 7 Drawing Sheets

(51) Int. Cl.

| | |
|---|---|
| ***A47G 1/16*** | (2006.01) |
| ***F21V 23/04*** | (2006.01) |
| ***F21V 33/00*** | (2006.01) |
| *F21Y 115/10* | (2016.01) |
| *F21W 131/405* | (2006.01) |

(58) Field of Classification Search

CPC .. A47F 3/06; A47F 5/12; A47F 5/0081; A47F 5/0807; A47F 5/0876; A47F 9/00; A47F 10/00; A47F 11/00; A47F 7/0042; A47F 10/02; A47G 1/16; A47G 2001/1673; A47G 1/02; A47G 1/06; A47G 1/0616; A47G 1/1606; A47G 2001/0677; F21V 23/0471; F21V 33/0028; F21W 2131/405; F21Y 2115/10; G09B 25/00; B65D 85/48

USPC ..... 186/35–38, 52–58

See application file for complete search history.

(56) References Cited

U.S. PATENT DOCUMENTS

| | | | | |
|---|---|---|---|---|
| 2,181,874 | A | 12/1939 | Cross | |
| 2,469,923 | A | 5/1949 | Jones | |
| 2,696,962 | A | 12/1954 | Goss | |
| 3,208,876 | A | 9/1965 | Dodge | |
| 3,274,721 | A | 9/1966 | Dreyer | |
| 3,283,431 | A | 11/1966 | Pearlman | |
| 3,471,111 | A | 10/1969 | MacDonald | |
| 3,471,112 | A | 10/1969 | MacDonald et al. | |
| 3,501,124 | A | 3/1970 | Goss | |
| 3,546,802 | A | 12/1970 | Preston | |
| 3,685,186 | A | 8/1972 | Goodman | |
| 3,853,226 | A | 12/1974 | Hine et al. | |
| 4,027,413 | A | 6/1977 | Moede | |
| 4,037,813 | A | 7/1977 | Loui et al. | |
| 4,053,132 | A | 10/1977 | Del Pozzo | |
| 4,084,700 | A | 4/1978 | Dunchock | |
| 4,324,332 | A | 4/1982 | Willis | |
| 4,432,523 | A | 2/1984 | Follows | |
| 4,557,457 | A | 12/1985 | Cockfield et al. | |
| 4,666,117 | A | 5/1987 | Taft | |
| 4,732,358 | A | 3/1988 | Hughes et al. | |
| 4,819,901 | A | 4/1989 | McDonald | |
| D301,413 | S | 6/1989 | Rosen | |
| 4,991,329 | A | 2/1991 | Wilson | |
| 5,380,080 | A | 1/1995 | Rubin et al. | |
| D364,055 | S | 11/1995 | Pakla | |
| 5,761,839 | A | 6/1998 | Heikkila | |
| 6,186,456 | B1 | 2/2001 | Marsh | |
| 6,286,802 | B1 | 9/2001 | Munson et al. | |
| 6,572,943 | B2 | 6/2003 | Shaffer | |
| 6,964,487 | B2 | 11/2005 | Olsen et al. | |
| D536,659 | S | 2/2007 | Panasewicz et al. | |
| 7,337,729 | B2 | 3/2008 | Briosi | |
| 7,967,400 | B1 | 6/2011 | Collum | |
| 8,468,767 | B1 | 6/2013 | McBride | |
| 8,495,830 | B2 | 7/2013 | Price | |
| D706,064 | S | 6/2014 | Ota et al. | |
| 9,027,766 | B1 | 5/2015 | Serotta et al. | |
| D758,771 | S | 6/2016 | Austin, III et al. | |
| D763,023 | S | 8/2016 | Austin, III et al. | |
| 9,468,314 | B2 * | 10/2016 | Goodwin | A47F 5/0838 |
| D799,862 | S | 10/2017 | Laumerich et al. | |
| 10,070,739 | B2 * | 9/2018 | Austin, III | A47F 7/0042 |
| 2002/0081409 | A1 | 6/2002 | Shaffer | |
| 2003/0038222 | A1 | 2/2003 | Holmes | |
| 2004/0074130 | A1 | 4/2004 | Chatterjea | |
| 2004/0221772 | A1 | 11/2004 | Narkis et al. | |
| 2005/0028418 | A1 | 2/2005 | Pargman | |
| 2005/0109910 | A1 | 5/2005 | Vander Berg et al. | |
| 2006/0022214 | A1 * | 2/2006 | Morgan | F21K 9/00 257/99 |
| 2007/0069358 | A1 | 3/2007 | McAllister et al. | |
| 2007/0153375 | A1 | 7/2007 | Peterson et al. | |
| 2008/0023615 | A1 | 1/2008 | Scarcello | |
| 2008/0072499 | A1 * | 3/2008 | Sibbett | A47F 7/0042 49/374 |
| 2008/0078916 | A1 | 4/2008 | Nevers et al. | |
| 2008/0148692 | A1 | 6/2008 | Wisecarver et al. | |
| 2008/0216374 | A1 | 9/2008 | Ozmun | |
| 2008/0236053 | A1 * | 10/2008 | Adams | A47F 7/30 52/36.1 |
| 2008/0237434 | A1 | 10/2008 | Lin | |
| 2008/0251413 | A1 | 10/2008 | Blumenau-Bebry | |
| 2009/0294610 | A1 | 12/2009 | Paharik et al. | |
| 2010/0060807 | A1 | 3/2010 | Green et al. | |
| 2010/0140428 | A1 | 6/2010 | Vassallo | |
| 2010/0229442 | A1 | 9/2010 | Snow et al. | |
| 2010/0276562 | A1 | 11/2010 | Nguyen | |
| 2011/0266406 | A1 | 11/2011 | Westimayer et al. | |
| 2011/0271571 | A1 | 11/2011 | Lennard | |
| 2012/0012542 | A1 * | 1/2012 | Brown | A47F 5/0043 211/26 |
| 2012/0030978 | A1 | 2/2012 | Miller | |
| 2012/0032062 | A1 | 2/2012 | Newville | |
| 2012/0103982 | A1 | 5/2012 | McDonald et al. | |
| 2012/0144708 | A1 | 6/2012 | Schwartz | |
| 2012/0145847 | A1 | 6/2012 | Wang | |
| 2012/0222341 | A1 | 9/2012 | Tucker | |
| 2012/0260549 | A1 | 10/2012 | Andrulewich | |
| 2012/0306188 | A1 | 12/2012 | Chen | |
| 2013/0026319 | A1 | 1/2013 | Crescenzo | |
| 2013/0048812 | A1 | 2/2013 | Lozano | |
| 2013/0112637 | A1 | 5/2013 | Kuhn | |
| 2013/0181042 | A1 | 7/2013 | Kressin et al. | |
| 2013/0256476 | A1 | 10/2013 | Ripke | |
| 2013/0256487 | A1 | 10/2013 | Ko | |
| 2013/0269170 | A1 | 10/2013 | Goldberg | |
| 2013/0321715 | A1 | 12/2013 | Millson et al. | |
| 2013/0325670 | A1 * | 12/2013 | Austin, III | A47F 7/0042 705/500 |
| 2014/0030490 | A1 | 1/2014 | Crosby et al. | |
| 2014/0231611 | A1 | 8/2014 | Svihilik | |
| 2014/0263923 | A1 | 9/2014 | McKinney | |
| 2014/0291460 | A1 | 10/2014 | Warncke et al. | |
| 2014/0319988 | A1 * | 10/2014 | Dietz | A47F 5/0087 312/326 |
| 2015/0071475 | A1 | 3/2015 | Hose et al. | |
| 2015/0075046 | A1 | 3/2015 | Skinner | |
| 2015/0170552 | A1 * | 6/2015 | Woelfel | G09F 5/04 211/55 |
| 2015/0208875 | A1 * | 7/2015 | Austin, III | A47F 7/0042 4/607 |
| 2015/0269875 | A1 | 9/2015 | Corcoran et al. | |
| 2015/0272352 | A1 | 10/2015 | Chowdhury et al. | |
| 2015/0335152 | A1 | 11/2015 | Buettner | |
| 2015/0335177 | A1 * | 11/2015 | Goodwin | A47F 5/0838 211/41.1 |
| 2015/0371321 | A1 * | 12/2015 | Chapuis | G09F 19/02 705/27.1 |
| 2016/0007742 | A1 | 1/2016 | Yang | |
| 2016/0290573 | A1 * | 10/2016 | Allen | F21K 9/233 |

FOREIGN PATENT DOCUMENTS

| | | | |
|---|---|---|---|
| CN | 201764226 | U | 3/2011 |
| CN | 203857240 | U | 10/2014 |
| CN | 204114511 | U | 1/2015 |
| CN | 204141192 | U | 2/2015 |
| DE | 102012100562 | A1 | 7/2013 |
| GB | 2508404 | A | 6/2014 |
| KR | 2020110007036 | | 7/2011 |
| KR | 2020120006811 | | 10/2012 |

OTHER PUBLICATIONS

The Source For Fine Art, "Glass Vs. Acrylic: Demystifying Glazing", 4 pages, Jan. 10, 2015.

Andscot Company, Inc., "Hang-It Brochure", 2 pages, Applicant Admitted Prior Art.

(56) References Cited

OTHER PUBLICATIONS

"Hangman® Wall Mounting Hardware", Ace Hardware, 3 pages, Applicant Admitted Prior Art.
"Decor Wonderland SSM13 Houston Modern Frameless Mirror", 6 pages, Applicant Admitted Prior Art.
"Rectangle Wall Mirror Frameless Beveled 24" X 36", Hook Included", Amazon.com, 24 pages, Applicant Admitted Prior Art.

* cited by examiner

MIRROR DISPLAY ASSEMBLY AND RETAIL DISPLAY SYSTEM

CROSS-REFERENCE TO RELATED APPLICATIONS

This application is a continuation-in-part of U.S. application Ser. No. 15/016,704 filed Feb. 5, 2016, now U.S. Pat. No. 9,924,809 B2, the disclosure of which is hereby incorporated in its entirety by reference herein.

TECHNICAL FIELD

Various embodiments relate to point-of-sale displays for mirrors and mirror assemblies.

BACKGROUND

Prior art mirrors and mirror assemblies are often offered preassembled and prepackaged.

SUMMARY

According to at least one embodiment, a retail display system is provided with a point-of-sale display unit sized to be received in a retail store aisle. A first plurality of mirror panes is oriented within the display unit. A second plurality of mirror panes is oriented within the display unit. The second plurality of mirror panes are formed from a different material composition that the material composition of the first plurality of mirror panes. A mirror display assembly is provided with a sample from the first plurality of mirror panes and a sample from the second plurality of mirror panes to visually demonstrate the material composition difference between the first plurality of mirror panes and the second plurality of mirror panes.

According to at least another embodiment, a mirror display assembly is provided with a support with a base. An image surface is mounted upon the base. A first mirror pane is mounted to the support and oriented at an angle relative to the image surface to reflect the image surface. A second mirror pane is provided with a different material composition than the first mirror pane. The second mirror pane is mounted to the support and oriented at an angle relative to the image surface to reflect the image surface.

According to at least another embodiment, a mirror display assembly is provided with a support with an image surface. A first mirror pane is mounted to the support, and oriented at an angle relative to the image surface to reflect the image surface. A second mirror pane has a different material property than the first mirror pane. The second mirror pane is mounted to the support, and oriented at an angle relative to the image surface to reflect the image surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
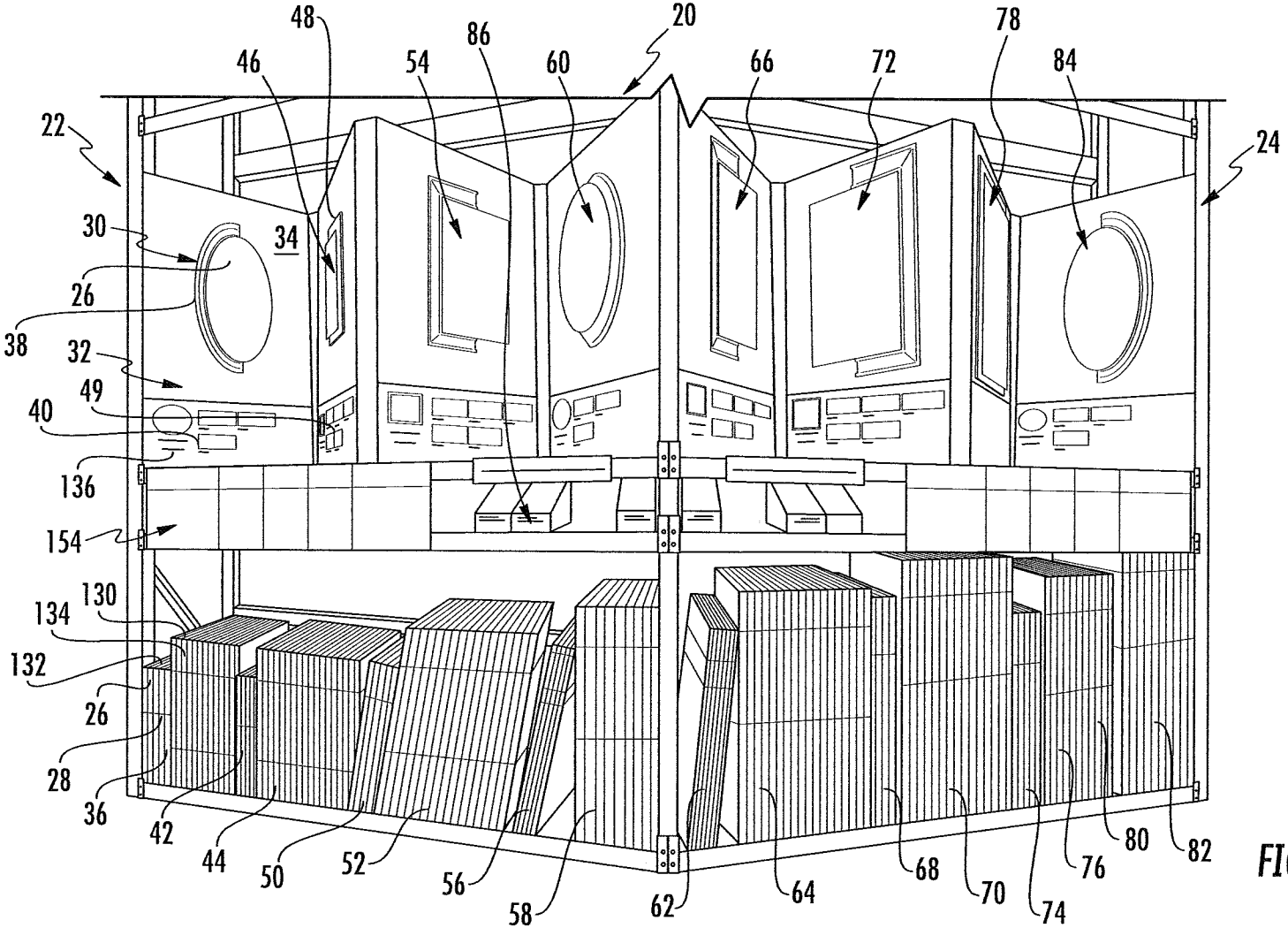
FIG. 1 is a panoramic perspective view of a retail display system for mirror assemblies according to an embodiment.

With reference to FIG. 1, a retail display system for mirror assemblies, is illustrated according to an embodiment, and referenced generally by numeral 20. The display system 20 is sized to be displayed within a retail store aisle, such as a home improvement store. The display system 20 is utilized for both displaying and retailing mirror assembly components.

The retail display system 20 includes a pair of point-of-sale display units 22, 24. Of course, any number of point-of-sale display units 22, 24 is contemplated; and as will be explained, it is advantageous to provide the greatest variety of products per each point-of-sale display unit 22, 24. The point-of-display units 22, 24 are sized to be received within a retail store aisle; and may be sized the same as conventional shelving for prior art mirror assembly retail displays for easy replacement.

The retail system 20 provides standardized or common mounting and assembly hardware to offer ease in customer selection, customization, assembly, installations, modifications, replacements, and the like. The retail system 20 includes a plurality of packaged mirror panes 26 of a small oval size and a particular style, such as standard glass. Adjacent to the mirror panes 26, are another plurality of packaged mirror panes 28 having a common size, small oval, with the first packaged mirror panes 26. The second packaged mirror panes 28 have a different style, however, such as deluxe glass, which may be clearer, have anti-fog treatment, a beveled perimeter edge, and/or etching.

An unpackaged mirror assembly 30, which includes one of the small oval mirror panes 26, is displayed in an upper region 32 of the display unit 22. The mirror assembly 30 is mounted to an upright support surface or wall 34 to illustrate the small oval mirror pane 26 in an installed orientation.

A user may desire an unframed mirror assembly, and may utilize one of the small oval mirror panes 26, 28 without a frame. However, if a user desires a framed mirror assembly, a plurality of small oval frames 36 are provided that are each sized to mount to one of the oval mirror panes 26, 28. The small oval frames 36 are offered in varying colors, finishes, ornamentation, widths, thicknesses and the like.

The mirror assembly 30 includes a half frame 38 to depict the mirror assembly 30 with and without a frame 36 to assist the user in making a decision. Additionally, multiple partial frame samples 40 are also provided on the wall 34 to illustrate other frame styles. The unpackaged mirror assembly 30 is aligned in the display unit 22 with the associated components, the small oval mirror panes 26, 28 and the small oval frames 36 so that these components are within a line of sight of the mirror assembly 30 to assist a customer in selecting the associated components.

The mirror pane and frame options may be repeated throughout the display system 20 to illustrate the various components. For example, the point-of-sale display unit 22 also includes small rectangular mirror panes 42 in standard and deluxe mirror materials. A variety of small rectangular frames 44 are provided adjacent the small rectangular mirror panes 42. A small rectangular mirror assembly 46 is provided in the upper region 32 with a half frame 48 and partial frame samples 49.

Additionally, medium rectangular mirror panes 50, medium rectangular frames 52, a medium rectangular mirror assembly 54, medium oval mirror panes 56, medium oval frames 58 and a medium oval mirror assembly 60 are provided in the point-of-display unit 22 with varying characteristics as described with the components for the small sized mirror components. Second medium rectangular mirror panes 62, second medium rectangular frames 64, a second medium rectangular mirror assembly 66, large rectangular mirror panes 68, large rectangular frames 70, a large rectangular mirror assembly 72, second large rectangular mirror panes 74, second large rectangular frames 76, a second large rectangular mirror assembly 78, large oval mirror panes 80, large oval frames 82, and a large oval mirror assembly 84, are provided within the point-of-display units 22, 24 offering varying styles at each of these sizes and shapes.

The display system provides mounting hardware kits 86 that are common or standardized for mounting any of the mirror panes 26, 28, 42, 50, 56, 62, 68, 74, 80. Although the hardware kits 86 are depicted as shelved on the point-of-display unit, the hardware kits 86 could be alternatively packaged with each of the packaged mirror panes 26, 28, 42, 50, 56, 62, 68, 74, 80.

The small oval frames 36 are retailed in packages 130 that also include cutouts 132 that expose the frame 36 and reveal that the frame 36 is packaged without a mirror pane 26, 28. The package 130 also includes informational indicia 134 that indicate the size, style and material of the frame 36. The indicia 134 is also color coded to correspond to the packages of the compatible mirror panes 26, 28. The display unit 22 may also include indicia 136 that is similarly color coded for the small oval mirror assembly 30 to indicate which components are associated with the displayed mirror assembly 30. These packaging features and informational indicia including color coding may be repeated throughout the display system 20 as illustrated for assisting customers in the selection process.

Figure 2:
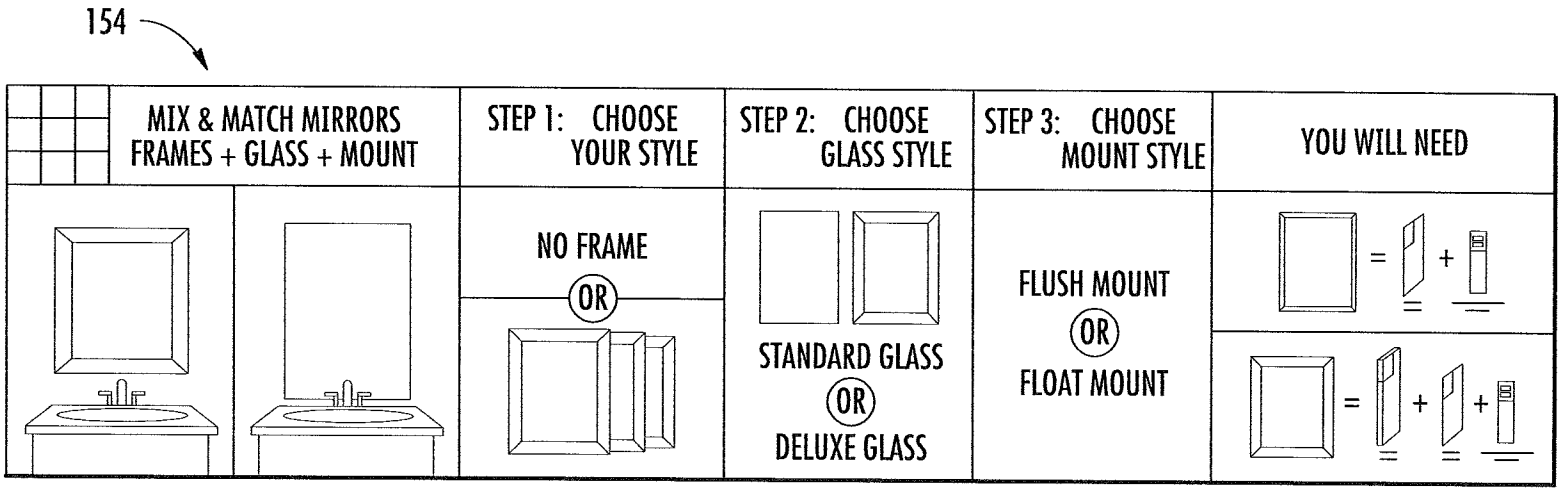
FIG. 2 is a front elevation view of instructional indicia of the retail display system of FIG. 1 according to an embodiment.

The display system 20 includes signage 154 with instructional indicia to inform the customer regarding a process to select the appropriate components for a desired mirror assembly. The signage is illustrated in greater detail in FIG. 2. In step 1, the customer, chooses a style, no frame or framed. If framed is desired, the customer selects a desired frame. In step 2, the customer selects a glass style, standard or deluxe. During this selection, the customer selects a mirror pane that matches the size and shape of the selected frame. In step 3, the customer determines if the installation will be flush mount or float mount, and the appropriate mounting hardware is selected.

Figure 3:
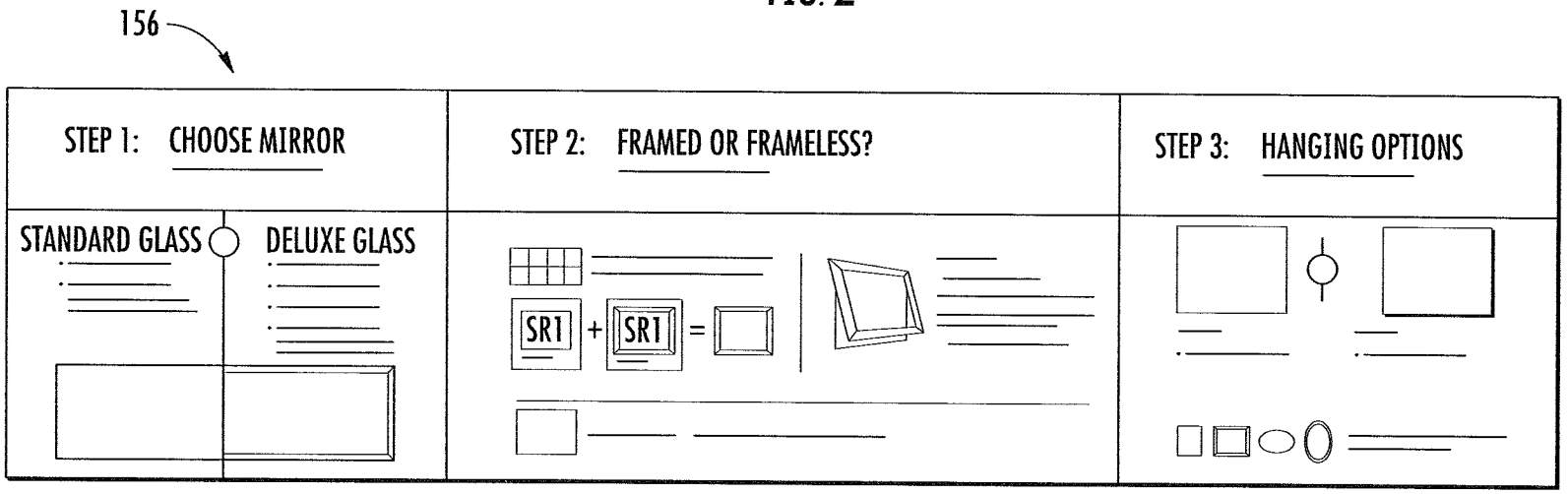
FIG. 3 is a front elevation view of instructional indicia of the retail display system of FIG. 1 according to another embodiment.

Signage 156 is illustrated in FIG. 3 according to another embodiment. In step 1, the customer selects a glass style, shape and size. In step 2, the customer determines if a frame is desired. If so, the customer selects a frame style that matches the size and shape of the selected glass shape and size. In step 3, the customer determines if the installation will be flush mount or float mount, and the appropriate mounting hardware is selected.

At a point-of-sale retail system, such as system 20, it may be difficult for a consumer to identify and appreciate the differences between mirrors of different material compositions. In order for the consumers to observe these differences, mirror glass samples are displayed at retail so the consumer can better differentiate color rendering capabilities of different material compositions, such as high definition mirror glass when compared to standard mirror glass.

Figure 4:
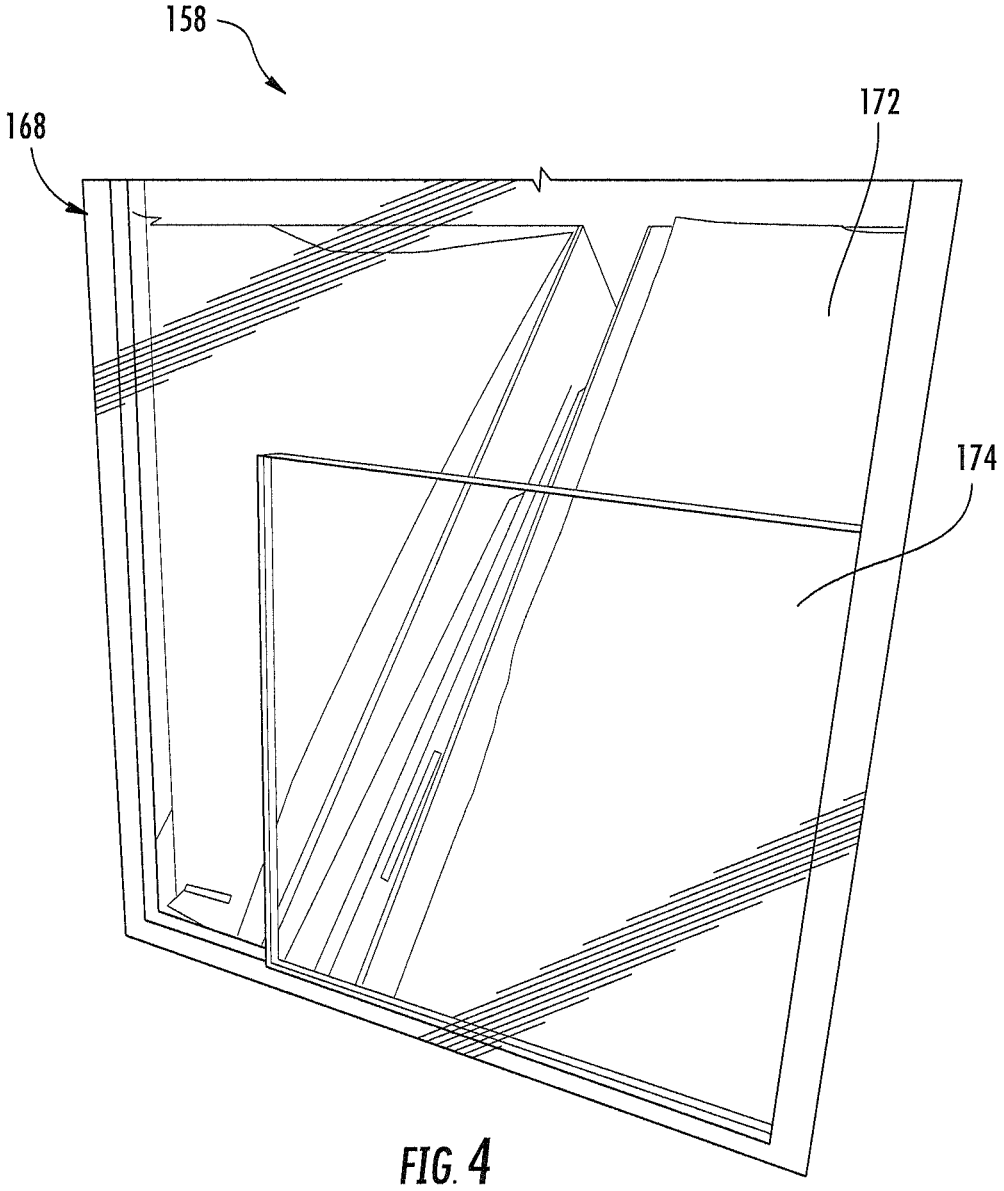
FIG. 4 is a front perspective view of a mirror display assembly according to an embodiment.
Figure 5:
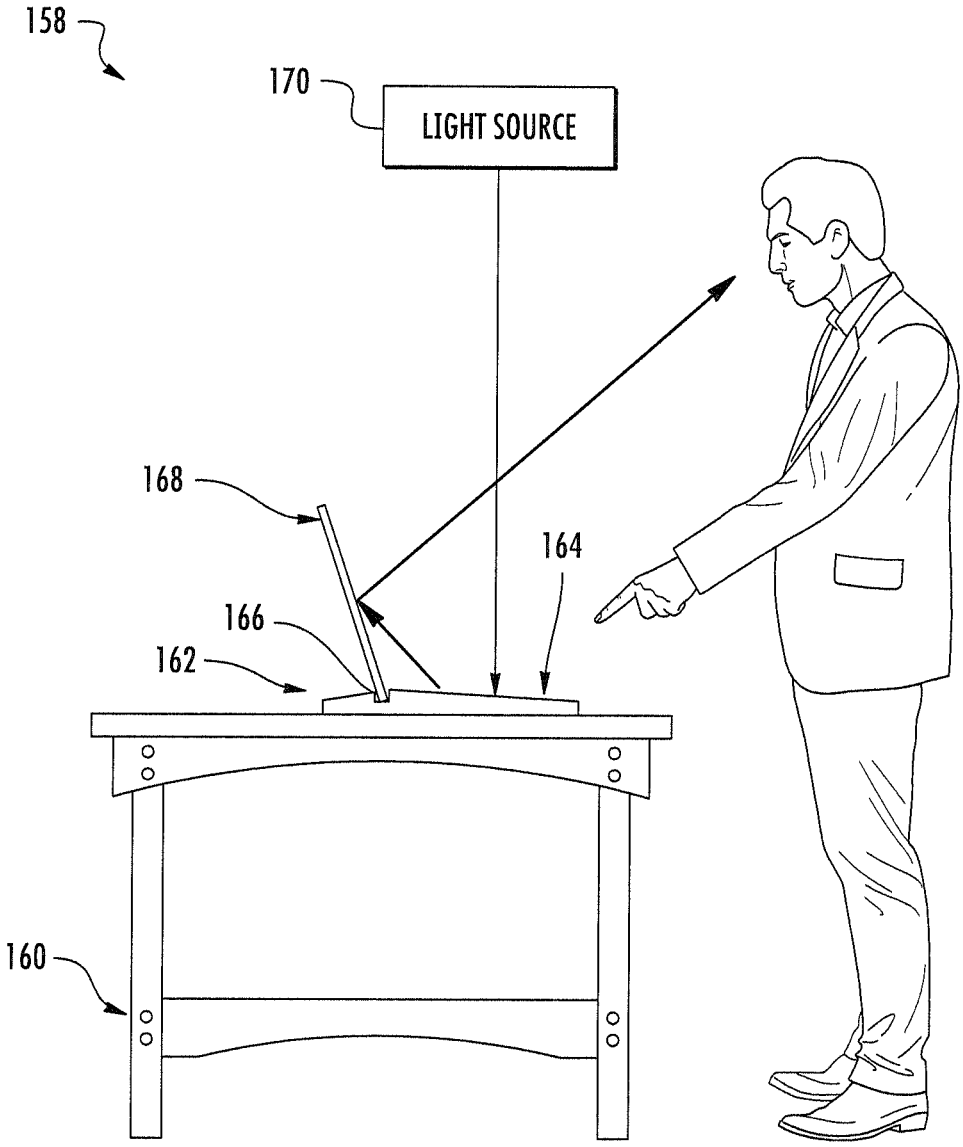
FIG. 5 is a side elevation view of the mirror display assembly of FIG. 4, according to another embodiment.

FIGS. 4 and 5 illustrate a mirror display assembly 158 according to an embodiment. The mirror display assembly 158 may employ a workbench 160 or any other support structure to support the mirror display assembly 158. The mirror display assembly 158 includes a base 162, which is supported atop the workbench 160. Alternatively, the base 162 may be formed integrally with the workbench 160 in order to support the mirror display assembly 158.

The base 162 provides an image surface 164 with an image that is viewable in the mirror display assembly 158. A slot 166 is formed in the base 162 sized to receive a mirror assembly 168. A light source 170 is employed to illuminate the image surface 164. The light source 170 may be provided by the lighting of the associated retail location. Alternatively, the light source 170 may be provided as a component in the mirror display assembly 158. The light source 170 is not in a direct line of sight while the observer is viewing the image surface 164 through the reflected image upon the mirror assembly 168. The light source 170 is also not visible indirectly through the reflected image.

The image surface 164 may include a light colored surface, picture or artwork so the image surface 164 is viewable through the mirror assembly 168. Referring again to FIG. 4, the mirror display assembly 168 includes two different glass mirror samples 172, 174. The first glass mirror sample 172 is manufactured from standard mirror glass. The second glass mirror sample 174 is manufactured from high definition glass. In this display example, the second glass mirror sample 174 is smaller and is layered on top of the larger first glass mirror sample 172. This arrangement allows an observer to view and compare the color rendering ability of both glass mirror samples 172, 174 in close proximity to each other at the same time and under the same lighting conditions. Alternatively, the glass mirror samples 172, 174 may be formed of generally equal size and placed adjacent to each other.

Typically, mirrors are sold at retail in a fully assembled state and may be framed or unframed. The prior art mirrors are also spaced apart within the display by a distance for accessibility and to prevent a display from looking cluttered.

High definition glass of the second sample 174 renders lighter color tones better than standard glass of the first sample 172. High definition glass is manufactured with a significant reduction of the copper and or iron mineral content within the glass substrate as compared to standard mirror glass. High definition or ultra-clear glass appears water white in clarity when viewed through an edge of the glass, whereas standard glass has a green hue. The difference in how well these glass mirror materials render lighter color hues or tones is not readily apparent when full size mirrors are spaced apart by a distance. The difference is visually detectable by the layering of the samples 172, 174 in the mirror assembly 168.

The mirror glass samples 172, 174 are placed under the same angle and lighting conditions while viewing a color controlled surface, photo, or artwork of the image surface. In the mirror display assembly 158 of FIG. 5, the light source 170 is oriented above the observer. Since the observer is looking down onto the image surface 164, the light source 170 provides ample illumination onto the image surface 164 without the observer viewing the light directly. Also, the mirror assembly 168 is positioned at an obtuse angle relative to the base 162 so that the light source 170 is not viewable indirectly through the reflected surface of the mirror assembly 168.

Figure 6:
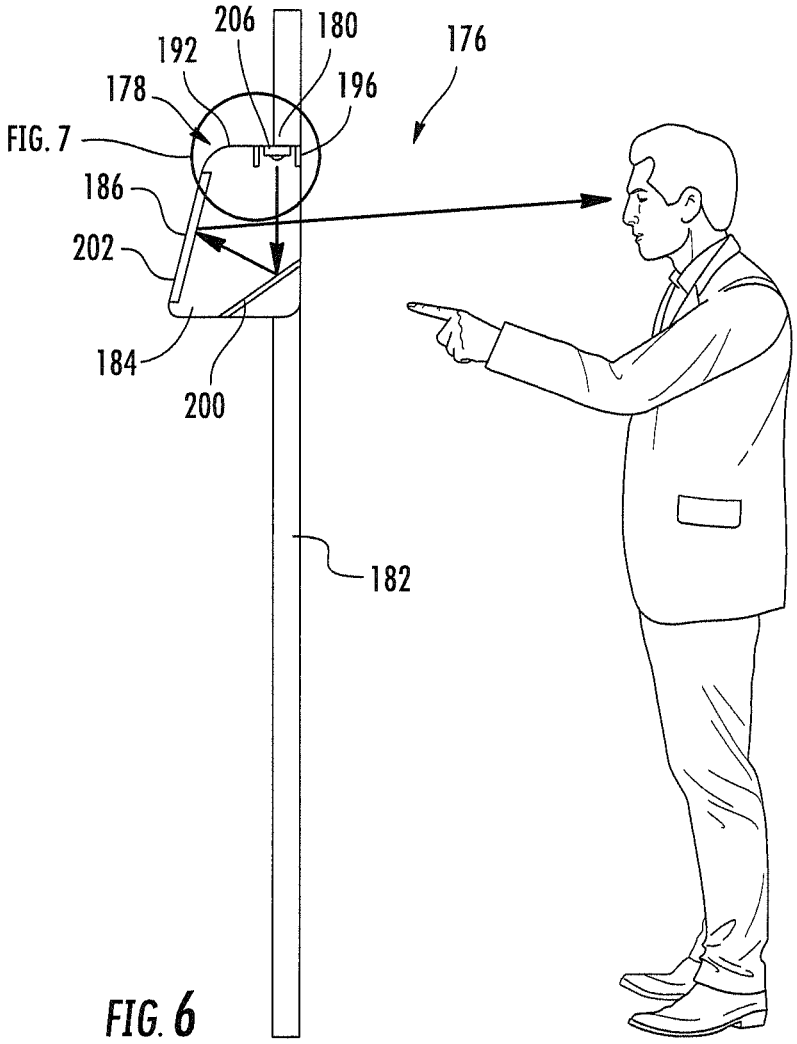
FIG. 6 is a side elevation view of a mirror display assembly according to another embodiment.
Figure 7:
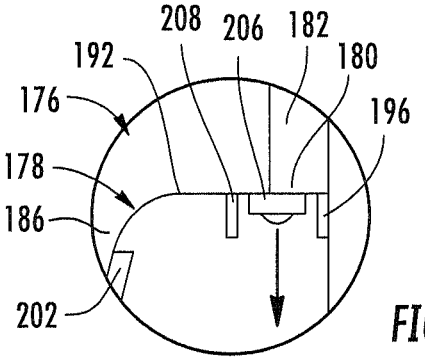
FIG. 7 is an enlarged side elevation view of the mirror display assembly of FIG. 6.
Figure 8:
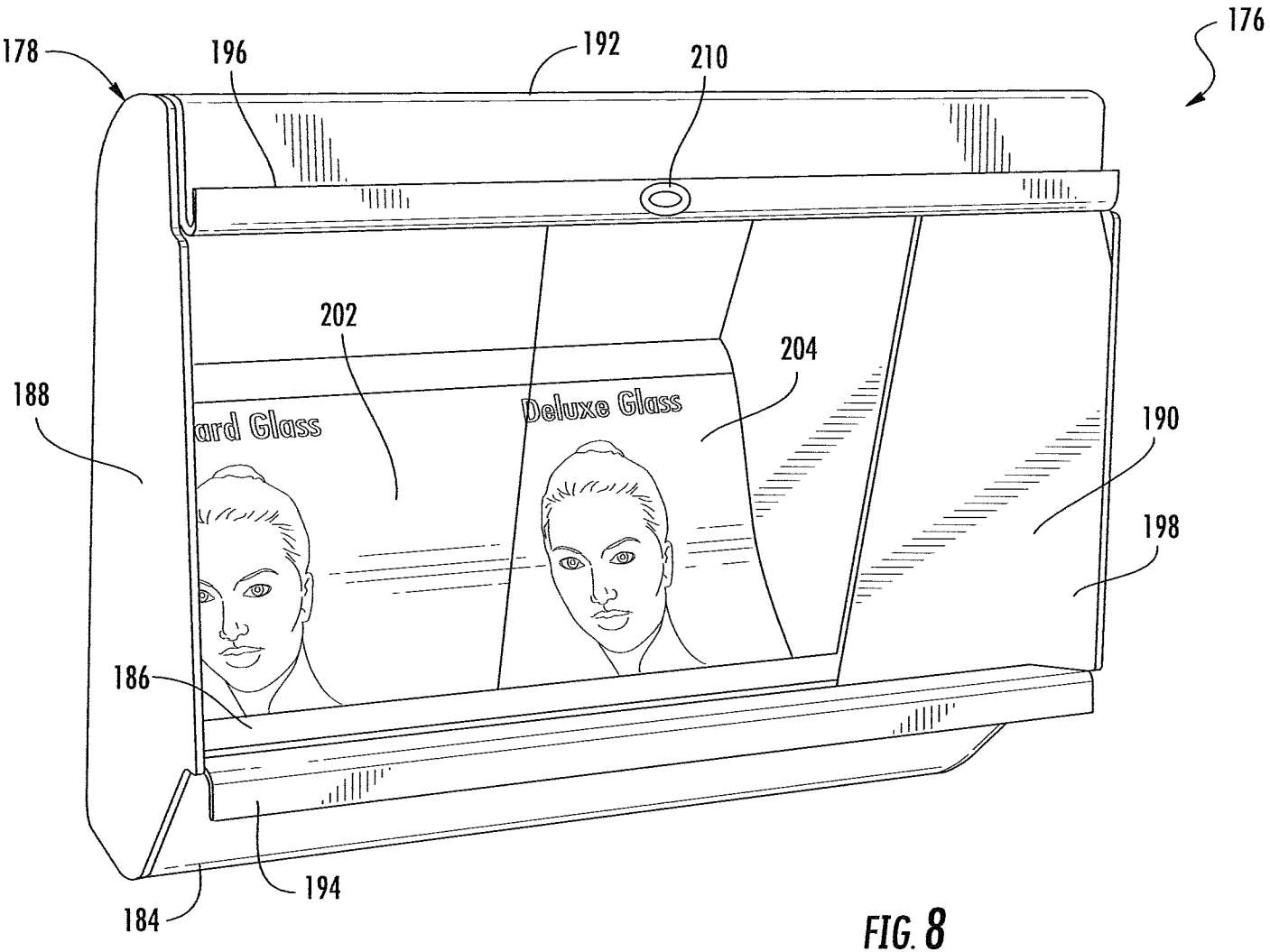
FIG. 8 is a front perspective view of the mirror display assembly of FIG. 6.

FIGS. 6-8 depict a mirror display assembly 176 according to another embodiment. The mirror display assembly 176 includes a housing 178 that is sized to mount within an opening 180 in an upright surface 182, such as a wall or panel of the display unit 22. The housing 178 includes a lower base 184, which extends rearward to a rear wall 186. The rear wall 186 and a pair of sidewalls 188, 190 extend upward to a hood 192. A lower frame bracket 194 connects the base 184 and the pair of sidewalls 188, 190. An upper frame bracket 196 connects the hood 192 and the pair of sidewalls 188, 190. The lower frame bracket 194, the sidewalls 188, 190, and the upper frame bracket 196 collectively define an opening 198 into the housing 178.

An image surface 200 is provided in the housing 178 upon the base 184. The rear wall 186 is provided at an acute angle relative to the base 184 to reflect the image surface 200. The image surface 200 is also angled relative to the base 184 to provide an acute angle with the rear wall 186 that is less than that between the rear wall 186 and the base 184. A first mirror glass sample 202 and a second mirror glass sample 204 are mounted upon the rear wall 186.

A light source 206 is mounted to the hood 192 above the image surface 200. The light source is directed towards the image surface 200. A pair of barriers 208, 196 is provided on either side of the light source 206 to obstruct the direct and indirect viewing of the light source 206 from the consumer. The upper frame bracket 196 can provide one of the barriers 196.

The light source 206 may be any suitable light source, such as a light emitting diode (LED) or an array of LEDs. The light source 206 may be hard-wired to an alternating current power source, or may be battery powered. The light source 206 may be illuminated continually. A motion sensor 210 may be provided to control the light source 206 to provide illumination in response to detection of a nearby consumer. Alternatively an interactive momentary contact switch may be provided on the display unit 22 to permit consumer controlled illumination by the light source 206. According to another embodiment, lighting may be from ambient or natural lighting via another opening in the top of the housing 178, or through the use of light-pipes to direct the lighting. Various suitable lighting arrangements are contemplated for suitable illumination of the image surface 200.

The image surface 200 is viewed through the glass mirror samples 202, 204 whereas the angle of reflection upon the glass mirror samples 202, 204 corresponds to angle of incidence of lighting upon the image surface 200. With this mirror display assembly 176, the observer can compare both mirror glass samples 202, 204 while the image surface 200 is hidden from view. The opening 198 limits a view direction of the observer. The mirror display assembly 176 may be positioned below the observer's horizontal sight line while in a standing position, such as ten to twenty degrees below the observer's horizontal sightline to further control the view direction.

Ultra-clear glass mirrors 204 are well suited for accurately rendering or reflecting light colors. The image surface 200 may utilize colors that have lighter tones for demonstrating material differences with the first mirror glass sample 202. According to one embodiment, the image surface 200 utilize colors exhibiting a measurable "lightness" level greater than or equal to a value of five under the Munsell Color System. Brighter white color temperatures may be employed in the light source 206 to further exemplify reflection characteristics.

Figure 9:
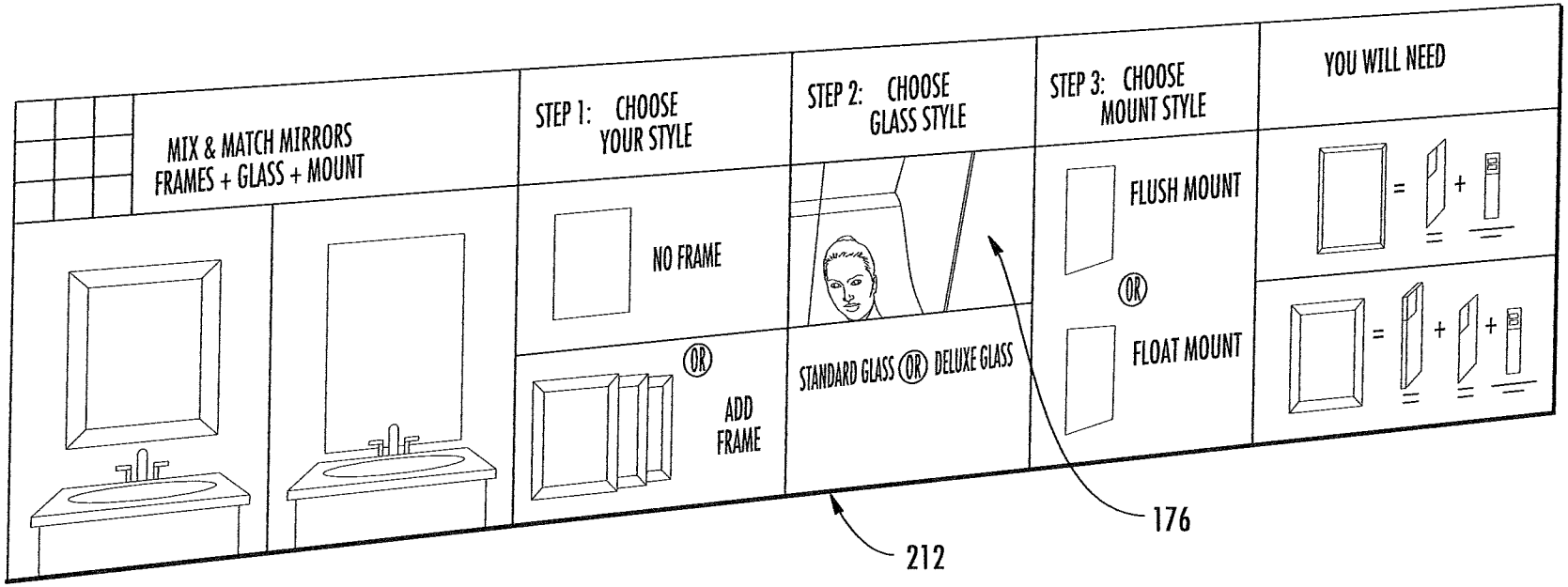
FIG. 9 is a front perspective view of instructional indicia of the retail display system of FIG. 1 according to another embodiment.

Signage 212 is illustrated in FIG. 9 according to another embodiment. In step 1, the customer determines if a frame is desired. In step 2, the customer selects a glass style. The mirror display assembly 176 is provided within the signage 212 to assist in the mirror glass selection. In step 3, the customer determines if the installation will be flush mount or float mount, and the appropriate mounting hardware is selected.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A retail display system comprising:

a point-of-sale display unit sized to be received in a retail store aisle;

a first plurality of mirror panes oriented within the display unit;

a second plurality of mirror panes oriented within the display unit, wherein the second plurality of mirror panes are formed from a different material composition than the first plurality of mirror panes;

an upright surface of the display unit with an opening;

an unpackaged mirror assembly mounted to the upright surface; and a mirror display assembly mounted within the opening of the upright surface, the mirror display assembly comprising:

a base extending rearward from the upright surface opening, a rear wall connected to the base and spaced rearward from the opening of the upright surface, a hood extending from the rear wall spaced apart from the base, a pair of spaced apart sidewalls connected to the base and the rear wall and extending upward to the hood, wherein the base, the hood, and the pair of sidewalls collectively provide an opening into the mirror display assembly, an image surface mounted upon the base, a visible light source mounted to the hood and directed to the image surface, a sample from the first plurality of mirror panes mounted to the rear wall and oriented at an angle relative to the image surface to reflect the image surface, and a sample from the second plurality of mirror panes with a different material composition than the sample from the first plurality of mirror panes, the sample from the second plurality of mirror panes mounted to the rear wall and oriented at an angle relative to the image surface to reflect the image surface;

wherein the hood extends over the image surface to the upright surface opening;

wherein the sample from the first plurality of mirror panes and the sample from the second plurality of mirror panes are directly mounted to a common surface of the rear wall, coplanar, abutting, and adjacent each other to demonstrate a difference in how the sample from the first plurality of mirror panes and the sample from the second plurality of mirror panes render light color hues or tones;

wherein the sample from the first plurality of mirror panes and the sample from the second plurality of mirror panes are oriented adjacent each other to visually demonstrate the material composition difference between the first plurality of mirror panes and the second plurality of mirror panes;

wherein the sample from the first plurality of mirror panes and the sample from the second plurality of mirror panes are not spaced apart by a distance to visually demonstrate the material composition difference between the first plurality of mirror panes and the second plurality of mirror panes, and to demonstrate a difference in how the first mirror pane sample and the second mirror pane sample render lighter color hues or tones;

wherein the pair of spaced apart sidewalls, the rear wall, and the hood partially enclose the mirror display assembly to obstruct the direct and indirect viewing of the light source; and wherein a viewing opening is defined between the base, the pair of sidewalls, and the hood.

2. The retail display system of claim 1, wherein the sample from the first plurality of mirror panes is oriented at a fixed angle relative to the image surface to reflect the image surface; and wherein the sample from the second plurality of mirror panes is oriented at a fixed angle relative to the image surface to reflect the image surface.

3. The retail display system of claim 1, further comprising instructional indicia provided on the upright surface of the display unit to inform a customer to select a mirror pane and associated hardware.

4. The retail display system of claim 3, wherein the mirror display assembly viewing opening is provided within the instructional indicia.

5. The retail display system of claim 4, wherein the mirror display assembly comprises a housing defined by the base, the rear wall, the hood, and the pair of sidewalls, mounted to the display unit.

6. The retail display system of claim 1, wherein the rear wall is oriented at a first acute angle relative to the base.

7. The retail display system of claim 6, wherein the image surface is oriented at a second acute angle relative to the rear wall that is less than the first acute angle.

8. The retail display system of claim 1, wherein the visible light source comprises a light emitting diode.

9. The retail display system of claim 1, further comprising a motion detector in cooperation with the light source to illuminate the light source in response to detection of motion proximate to the mirror display assembly.

10. The retail display system of claim 1, wherein the image surface includes at least one color with a Munsell Color System level of at least five in lightness.

11. The retail display system of claim 1, wherein the sample from the first plurality of mirror panes is oriented at a fixed acute angle relative to the image surface to reflect the image surface; and wherein the sample from the second plurality of mirror panes is oriented at a fixed acute angle relative to the image surface to reflect the image surface.

* * * * *